US005410813A

United States Patent [19]

Carlson

[11] Patent Number: 5,410,813

[45] Date of Patent: May 2, 1995

[54] TOOL FOR CUTTING SHEET MATERIAL

[75] Inventor: Paul S. Carlson, Urbana, Ill.

[73] Assignee: Hobbico, Inc., Champaign, Ill.

[21] Appl. No.: 317,779

[22] Filed: Oct. 4, 1994

Related U.S. Application Data

[63] Continuation of Ser. No. 37,137, Mar. 25, 1993, abandoned.

[51] Int. Cl.[6] ..... B26B 29/02

[52] U.S. Cl. ..... 30/287; 30/293; 30/294

[58] Field of Search ..... 30/294, 293, 287, 289, 30/286, 280, 314

[56] References Cited

U.S. PATENT DOCUMENTS

| | | | |
|---|---|---|---|
| 3,395,453 | 8/1968 | Prates | 30/294 |
| 3,673,687 | 7/1972 | Phillips et al. | 30/294 |
| 3,991,467 | 11/1976 | Yokoyama | 30/294 |
| 4,043,038 | 8/1977 | Selfridge | 30/294 |
| 4,064,626 | 12/1977 | Meshulam et al. | 30/294 |
| 4,262,418 | 4/1981 | Hill et al. | 30/294 |
| 4,817,290 | 4/1989 | Baughman | 30/294 |
| 5,044,081 | 9/1991 | Nguyen | 30/294 |

*Primary Examiner*—Hwei Siu Payer

*Attorney, Agent, or Firm*—Gardner, Carton & Douglas

[57] ABSTRACT

A tool for precisely severing sheet material at a uniform predetermined distance from the line of intersection of two surfaces. A wide variety of precise cutting operations may be performed, including operations that leave a uniform predetermined overlap and operations that precisely sever the sheet material at the line of intersection. The tool has a body with a flat bottom surface, a straight front edge, a beveled surface extending between the front edge and the bottom surface and thumb screws for securely retaining a cutting blade. Also disclosed is a removable spacer plate which may be engaged with the body to perform additional cutting operations.

13 Claims, 3 Drawing Sheets

FIG. 3
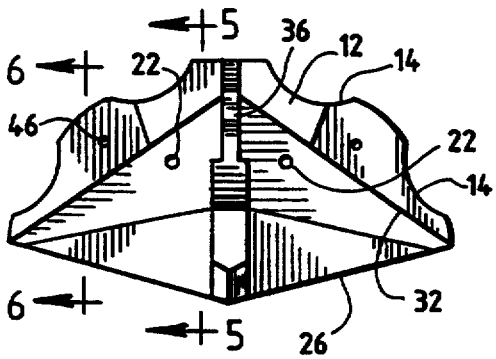
FIG. 4
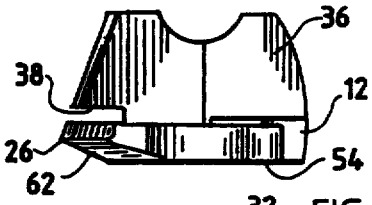
FIG. 5
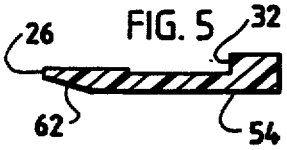
FIG. 6
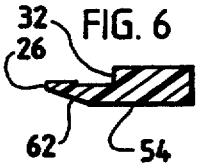
FIG. 8
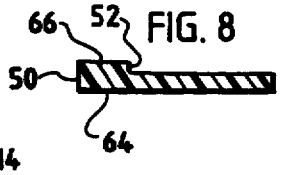
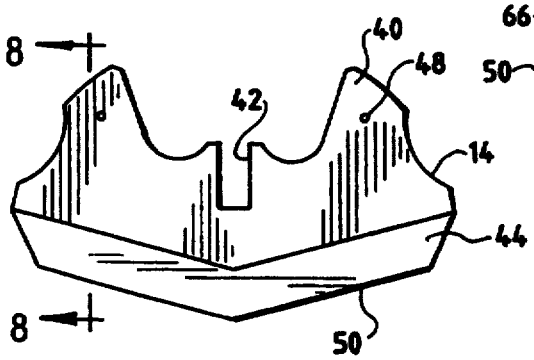
FIG. 7
FIG. 11
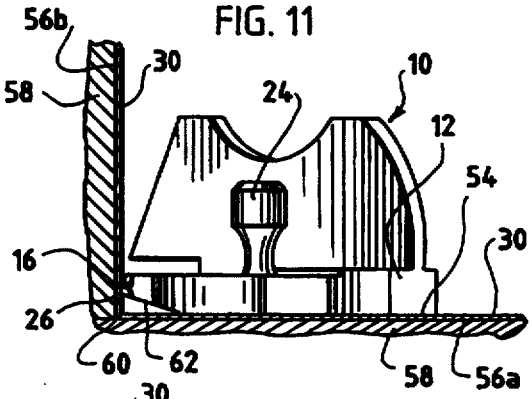
FIG. 12
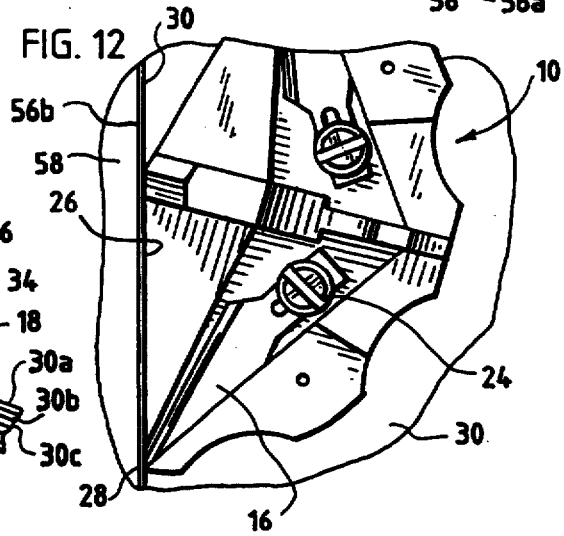
FIG. 9
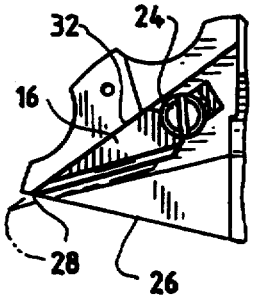
FIG. 10
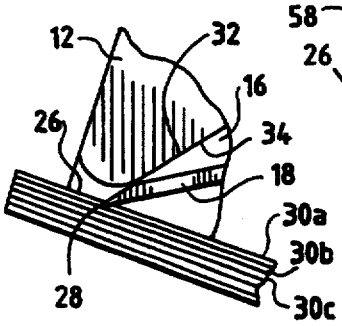

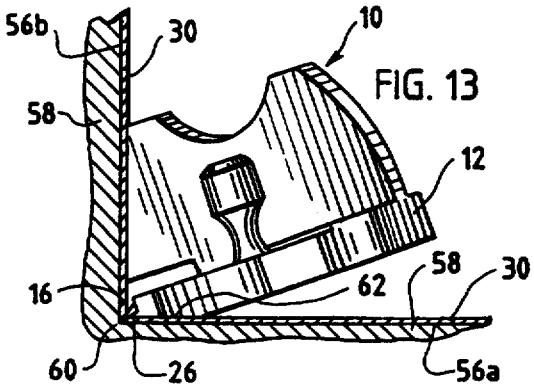
FIG. 13
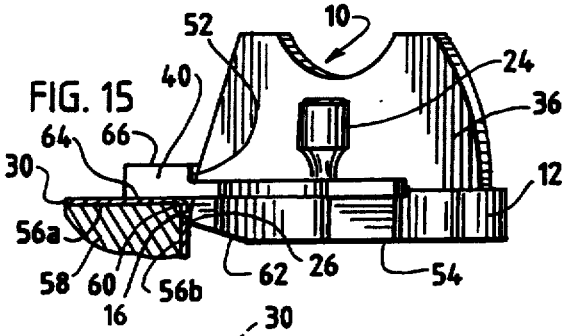
FIG. 15
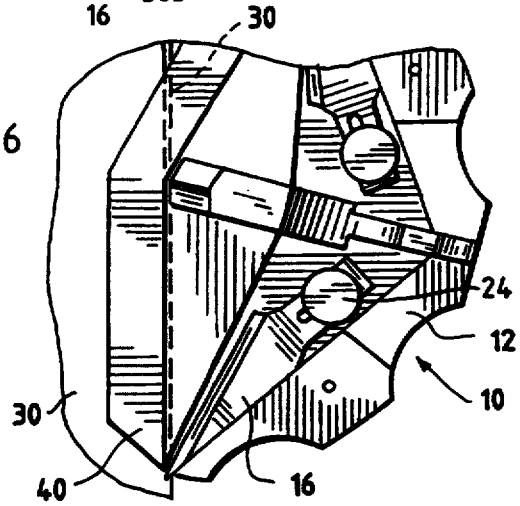
FIG. 16
FIG. 14
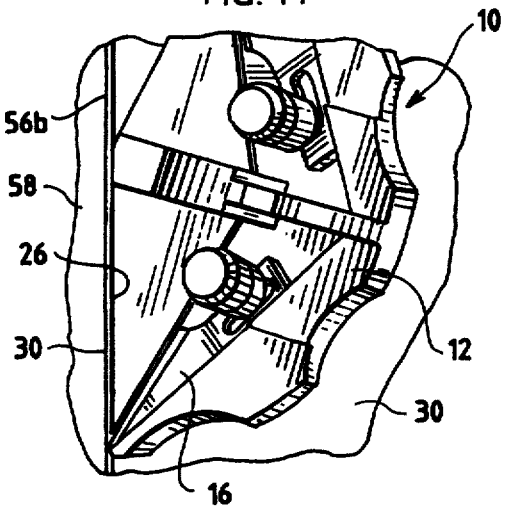
FIG. 18
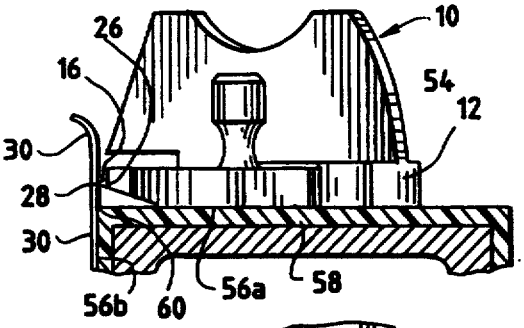
FIG. 17
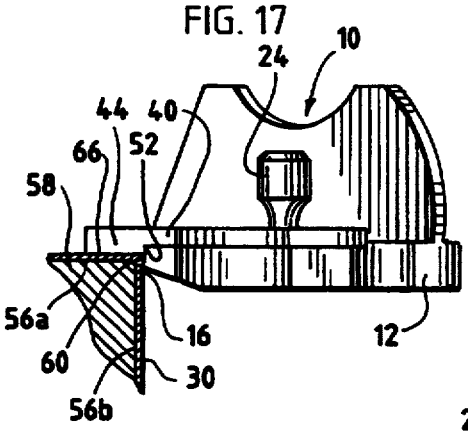
FIG. 19
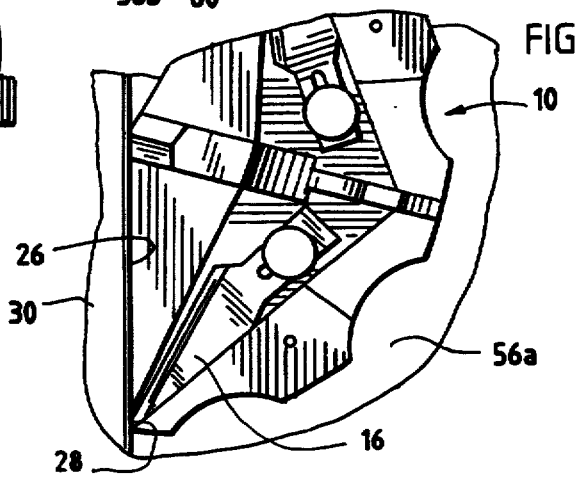

TOOL FOR CUTTING SHEET MATERIAL

This is a continuation of application Ser. No. 08/037,137 filed Mar. 25, 1993, now abandoned.

FIELD OF THE INVENTION

The present invention relates generally to tools for cutting sheet material, such as wallpaper or coating film used to cover a structure, and relates more particularly to such a tool adapted to perform a wide variety of precise cutting operations.

BACKGROUND OF THE INVENTION

It is common practice to cover a structure with sheet material for purposes of decoration, protection or reinforcement of the structure. A typical example of a decorative application is wallpaper applied to a wall or similar surface, in order to provide an aesthetically pleasing appearance or a particular desired design. Another typical application utilizing sheet material relates to the construction and design of models, such as scale replicas of airplanes, boats, automobiles or other structures. Such models are usually constructed of a series of spaced apart ribs carved from balsa wood sheets that collectively define a contour such as a camber along a wing or the general shape of the body of the model. A sheet material is applied upon the network of ribs thereby forming a generally smooth continuous surface of the model as defined by the underlying balsa wood structure. The sheet material is preferably comprised of a thin film which serves to define a three dimensional shape and protect the balsa wood structure from exhaust or moisture, as well as to reinforce the balsa wood structure.

In such applications, it is highly desirable to cut the sheet material during application in a smooth, straight line. It is also usually highly desirable to cut the sheet material during application at a predetermined uniform distance from a border or edge. A uniform cut likely improves adherence of the sheet material to the structure to which it is applied, and is generally a prized aesthetic characteristic.

SUMMARY OF THE INVENTION

It is an object of the present invention to provide a tool for cutting sheet material that may be used to perform a wide variety of precise cutting operations.

It is another object of the present invention to provide such a tool that may be used to precisely cut sheet material along an "inside" border defined by the intersection of two surfaces.

It is another object of the present invention to provide such a cutting tool that may be used to precisely cut sheet material along an "inside" border defined by the line of intersection of two surfaces such that a uniform predetermined overlap of the sheet material extends parallel to the line of intersection.

It is another object of the present invention to provide such a tool that may be used to precisely cut sheet material along an "outside" edge defined by the line of intersection of two surfaces.

It is another object of the present invention to provide such a cutting tool that may be used to precisely cut sheet material along an "outside" edge defined by the line of intersection of two surfaces such that a uniform predetermined overlap of the sheet material extends parallel to the line of intersection.

It is another object of the present invention to provide such a cutting tool that may be adjusted to selectively provide a plurality of uniform overlaps of sheet material extending parallel along an "inside" border, or an "outside" edge, defined by the line of intersection of two surfaces.

It is yet another object of the present invention to provide a tool for cutting sheet material which may be adjusted to vary the depth of the cut to any depth within a predetermined range.

The above and additional objects are realized in the present invention which provides a tool capable of performing a wide variety of cutting operations on sheet material applied to the surface of a structure. The tool is comprised of a body with a primary flat surface and a beveled leading edge, a plurality of abutment surfaces for precisely maintaining the tool in a desired orientation with respect to the structure, means for securely retaining one or more cutting blades and an adjustable spacer plate.

The primary flat surface may be used to slidingly guide the tool to perform a cutting operation that precisely severs the sheet material at a uniform predetermined distance parallel to the line of intersection of two surfaces. In a similar manner, the beveled leading edge may be used to cut the sheet material precisely coincident with the line of intersection of two surfaces. The surface of the spacer plate may be similarly used to precisely sever sheet material at a predetermined distance parallel to the line of intersection of two surfaces. Preferably, the cutting blade may be adjusted to vary, within a predetermined range, the depth of the cut performed by the tool.

BRIEF DESCRIPTION OF THE DRAWINGS

Other objects and advantages of the invention will be apparent from the following detailed description and upon reference to the drawings, in which:

FIG. 3 is a top view of the body of a preferred embodiment of the invention;

FIG. 4 is a side view of the body of a preferred embodiment of the invention;

FIG. 5 is a sectional view taken at 5—5 from FIG. 3;

FIG. 6 is a sectional view taken at 6—6 from FIG. 3;

FIG. 7 is a top view of a spacer plate according to a preferred embodiment of the invention;

FIG. 8 is a sectional view taken at 8—8 from FIG. 7;

FIG. 9 is a magnified top view depicting the range of adjustment of a cutting blade according to a preferred embodiment of the invention;

FIG. 10 is a magnified top view depicting a cutting operation whereby only one of several layers of sheet material is severed;

FIG. 11 is a side view depicting a cutting operation at an "inside" edge whereby sheet material is severed precisely at a uniform predetermined distance from the line of intersection of two surfaces;

FIG. 12 is a top view depicting the cutting operation of FIG. 11;

FIG. 13 is a side view depicting a cutting operation at an "inside" edge where sheet material is severed precisely at the line of intersection of two surfaces;

FIG. 14 is a top view depicting the cutting operation of FIG. 13;

FIG. 15 is a side view depicting a cutting operation at an "outside" edge using a spacer plate;

FIG. 16 is a top view depicting the cutting operation of FIG. 15;

FIG. 17 is a side view depicting another cutting operation at an "outside" edge using a spacer plate;

FIG. 18 is a side view illustrating another cutting operation at an "outside" edge;

FIG. 19 is a top view illustrating the cutting operation of FIG. 18.

DETAILED DESCRIPTION OF THE PREFERRED EMBODIMENT

Figure 1:
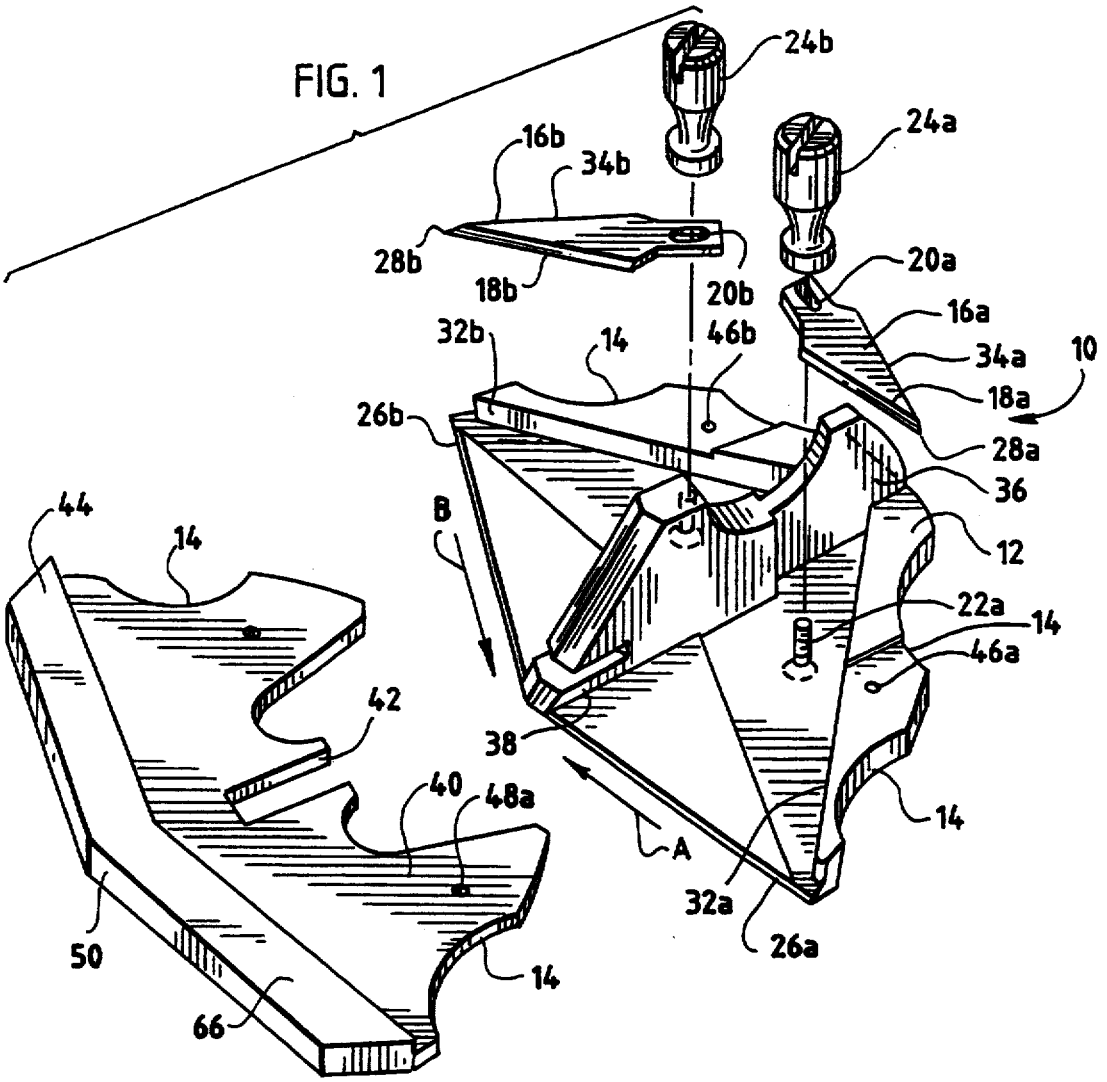
FIG. 1 is an exploded perspective view of a preferred embodiment of the invention.
Figure 2:
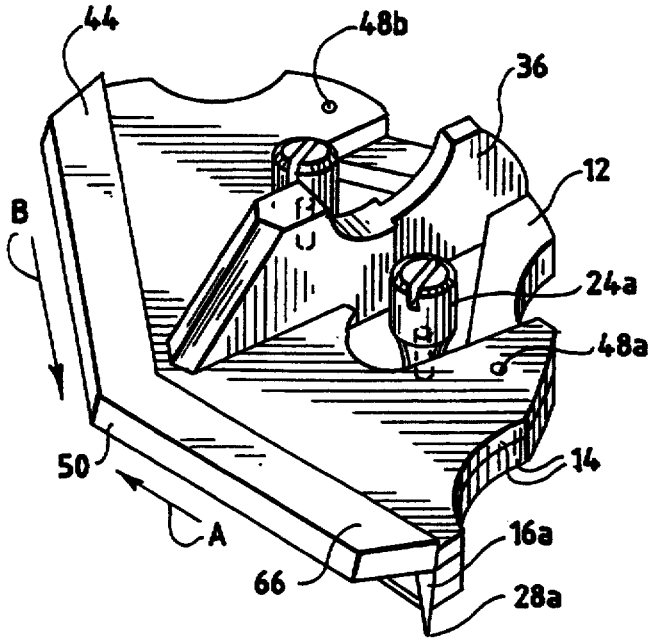
FIG. 2 is a perspective view of the embodiment of the invention as depicted in FIG. 1.

While the invention is susceptible to various modifications and alternative forms, a preferred embodiment thereof has been shown by way of example in the drawings and will herein be described in detail. It should be understood, however, that it is not intended to limit the invention to the particular form described, but to the contrary, the intention is to cover all modifications, equivalents, and alternatives falling within the spirit and scope of the invention as defined by the appended claims.

Turning now to the drawings and referring first to FIG. 1, there is shown a cutting tool according to a preferred embodiment of the invention. The tool 10 is comprised of a body 12 with a number of recesses 14 to facilitate grasping and securely holding the tool 10 by hand. A pair of cutting blades **16*a*, 16*b* are provided, which preferably have a sharp leading 18*a*, 18*b* edge capable of cleanly and easily severing sheet material. Holes 20*a*, 20*b* at the base of the blades 16*a*, 16*b* allow each of the blades 16*a*, 16*b* to be received upon threaded members 22*a*, 22*b* which are fixed to, and extend generally perpendicular to the surface of, the body 12 of the tool 10. The blades 16*a*, 16*b* may be securely fastened to the body 12 by means of thumb screws 24*a*, 24*b* carried on the threaded members 22*a*, 22*b*. Thumb screws 24*a*, 24*b* may be tightened against the blades 16*a*, 16*b* to securely fasten them to the body 12**.

According to an important aspect of the present invention, the holes **20*a*, 20*b* in the blades 16*a*, 16*b* will be longitudinal, as depicted in FIG. 1, thereby defining a longitudinal range of adjustment of the blades with respect to the body of the tool. Referring now to FIGS. 9 and 10, the cutting portion of the blade 16 is at the tip 28, and is defined by the portion of the blade 16 that extends beyond the front edge 26 of the body 12 of the tool 10. Preferably, the threaded member 22 will be disposed at a distance from the front edge 26 that provides a range of adjustment of the blade 16 that extends from a completely retracted position, where the tip 28 of the blade 16 is retained behind the front edge 26 of the body 12, to a completely extended position where the tip 28 of the blade 16 extends well beyond the front edge 26 of the body 12 of the tool 10. As can be seen, the position of the blade 16 may be finely adjusted and set to any point within the entire range from the completely retracted position to the completely extended position. When the tool 10 is not in use, the blade 16 may be retracted to avoid accidental injury or damage to the blade 16**.

As can be seen from FIG. 10, the blade 16 may be finely adjusted so that the tip 28 of the blade 16 extends just slightly beyond the front edge 26 of the body 12. Such an arrangement advantageously allows the tool 10 to be used in an application where it is desired to sever only the top layer **30*a* of several layers 30*a*, 30*b*, 30*c***. . of sheet material applied to the surface of a structure. Similarly, the position of the blade may be adjusted to cut through two or more of multiple layers of sheet material applied to a structure. Another advantage of the fine blade adjustment feature is that it allows sheet material to be severed without damage to the underlying structure.

As is apparent from the drawings, according to a preferred embodiment the tool 10 is symmetrical about its central transverse axis, thereby defining a first side, with elements generally denoted with an "a," as well as a second side, with elements generally denoted with a "b." The symmetrical design allows the tool 10 to effectively be used to sever sheet material in two directions. The "b" side will preferably be used in order to sever sheet material when the tool 10 is moved in the direction noted by the arrow B, i.e., generally parallel to the front edge 26 of the "b" side. This will ensure that the sharp, cutting edge **18*b* of the blade 16*b* will effectively engage and sever sheet material when the tool 10 is moved in the B direction. Conversely, the sharp, cutting edge 18*a* of the blade 16*a* will effectively engage and sever sheet material when the tool 10** is moved in the A direction.

In order to further secure the blades 16 and prevent them from rotating about the threaded member 22, particularly when force is applied during cutting, the body 12 of the tool is provided with an abutment wall 32 extending parallel to, and in positional agreement with, the back of the blade 34. The wall 32, therefore, serves to maintain the positional relationship of the blade 16 with the body 12, which, absent the wall 32, would tend to move back or away from the front edge 26 when pressure is applied during cutting.

As seen in FIG. 1, the body 12 of the tool 10 includes a transverse fin 36 with a slot 38 for receiving a removable spacer plate 40. The generally flat spacer plate 40 includes a complimentary slot 42, as well as a front lip 44 that extends above the surface on one side of the spacer plate 42. The fin slot 38 is adapted to engage with the upper and lower surfaces of the spacer plate 40, and in a complimentary manner, the spacer plate slot 42 is adapted to engage with the transverse fin 36, so that the body 12 of the tool 10 and the spacer plate 40 may be joined in agreement.

In order to retain the spacer plate 40, the body 12 of the tool 10 may be provided with one or more nipples 46 which register with complimentary detents 48 which may be formed from small holes 48 in the spacer plate 40. When the spacer plate 40 is joined in agreement with the body 12, the back and side edges of the spacer plate 40 generally closely follow the contour of the body 12. Although the front edge 50 of the spacer plate 40 generally parallels the front edge 26 of the body 12, the front edge 50 of the spacer plate 40 extends a distance beyond the front edge 26 of the body 12, as depicted more clearly in FIGS. 15 and 17. The spacer plate 40 may be joined with the body 12 with the lip extension 52 on top, as depicted in FIG. 15, or if turned over, it may be joined with the body 12 so that the lip extension 52 is on the bottom, as depicted in FIG. 17. As will be apparent, the tool 10 may be used for certain applications with the spacer plate 40 removed, while other applications, as illustrated in FIGS. 15 and 17, are best performed with the spacer plate 40 joined with the body 12 of the tool 10.

According to an important aspect of the invention, the body 12 has a relatively smooth and substantially flat bottom surface 54, which promotes the ability to smoothly and evenly slide the tool 10 upon the relatively flat surface of a structure. As can be seen from FIG. 11, the blade 16 is maintained at a precise predetermined distance from the bottom surface 54 of the body 12 and, accordingly, the surface 56a of a structure 58 upon which the tool 10 engages, even as the tool 10 slides about the surface 56a of the structure 58.

FIGS. 11 and 12 illustrate operation of the tool 10 to sever sheet material 30 at a uniform predetermined distance from the line of intersection 60 of two surfaces 56a, 56b. It should be noted that, in order to perform the cutting operation illustrated in FIGS. 11 and 12, the spacer plate 40 is removed from the body 12. In operation, the tool 10 is slidingly guided upon one surface 56a by engagement of the bottom surface 54 of the body 12 upon the surface 56a. The tool 10 is also slidingly guided with respect to the other surface 56b by engagement of the front edge 26 of the body 12 upon the surface 56b. As can be seen, when the tool slides along the surfaces 56a, 56b, the blade 16, the tip 28 of which extends beyond the front edge 26, severs the sheet material 30 applied to the surface 56b at a uniform predetermined distance from the line of intersection 60 defined by the surfaces 56a, 56b.

Turning now to FIGS. 13 and 14, there is illustrated operation of the tool 10 to sever sheet material 30 precisely at the line of intersection 60 defined by two surfaces 56a, 56b. According to an important feature of the present invention, the body 12 of the tool 10 includes a flat beveled lower surface 62 at the front or leading edge. The beveled surface 62 serves to maintain the tool 10 at a predetermined angle with respect to the surface 56a of a structure 58. As before, the front edge 26 of the body 12 slidingly guides the tool 10 along the surface 56b, while the blade 16 which extends beyond the front edge 26 is directed, due to the angle defined by the beveled surface 62, precisely into the line of intersection 60 of the two surfaces 56a, 56b. When the tool 10 is slidingly guided along the surfaces 56a, 56b, while the beveled edge 62 is engaged, sheet material 30, which is applied across the intersection 60, is precisely severed at the line of intersection 60 of the two surfaces 56a, 56b. As a result, the sheet material 30 may be advantageously applied to only one surface 56a and will extend precisely up to the border 60 with the other surface 56b.

Turning now to FIGS. 15 and 16, there is illustrated operation of the tool of the present invention to sever sheet material 30 at a predetermined uniform distance from the edge 60 defined by the "outside" intersection of two surfaces. The arrangement of the surfaces depicted in FIG. 15 is denoted as "outside" because the angle between the two surfaces 56a, 56b is greater than 180°; as illustrated the angle between the two surfaces 56a, 56b is substantially 270°.

As shown in FIG. 15, the flat surface 64 of the spacer plate 40 slidingly engages with the surface 56a of the structure 58, thereby maintaining the blade 16 at a predetermined distance from the surface 56a of the structure 58, even as the spacer plate 40 slides upon the surface 56a of the structure 58. The front edge 26 slidingly guides the tool 10 with respect to the surface 56b of the structure 58. As the tool 10 slides along the surfaces 56a, 56b, the blade 16, which extends beyond the front edge 26 of the body 12, severs sheet material 30 on the surface 56b at a uniform predetermined distance from the edge 60.

A similar cutting operation is illustrated in FIG. 17, when the surface 66 of the extension 52 of the lip 44 engages with, and guides the tool 10 with respect to, the surface 56a of the structure 58. In this arrangement, the extension 52 of the lip 44 operates to maintain the blade 16 at a uniform predetermined distance from the edge 60, a distance which is less than the distance when the spacer plate 40 is turned over with respect to the body 12 of the tool 10. As should be apparent, the differences between these two distances is defined by the distance that the extension 52 of the lip 44 extends above the surface of the spacer plate.

Another cutting operation is illustrated in FIGS. 18 and 19, where the bottom surface 54 of the body 12 slidingly engages one surface 56a of a structure 58, thereby precisely maintaining the blade 16 at a uniform predetermined distance from the surface 56a of the structure 58. Although the front edge 26 of the body 12 does not engage directly the surface 56b of the structure 58, it may easily be maintained in positional alignment by hand. The tool 10 may be grasped by a user such that a pair of fingers resting on the front edge 26 and extending upon the surface 56b ensure that the front edge 26 of the body 12 is aligned with the surface 56b of the structure 58. This cutting operation may be practiced without risk of injury since the tip 28 of the blade 16 extends beyond the front edge 26 only at the far end of the front edge 26. Thus, the front edge 26 may be safely aligned with the surface by using a substantial portion of the front edge 26 other than at the end where the blade 16 extends.

As can be seen from FIGS. 18 and 19, when the tool 10 is moved along the surfaces 56a, 56b guided directly by the bottom surface 54 maintained in alignment with surface 56a and indirectly by the front edge 26 maintained in alignment with the surface 56b, the sheet material 30 extending from the surface 56b will be precisely severed at a uniform predetermined distance from the line of intersection 60 of the two surfaces 56a, 56b. Such a cutting operation will result in a uniform overlap of sheet material 30 that may then be applied to the surface 56a.

As should be apparent from the cutting operation illustrated in FIGS. 18 and 19, another cutting operation may be similarly performed by maintaining the beveled surface 62 of the body 12 upon the surface 56a. Thus, when the tool 10 is moved along the surfaces 56a, 56b, due to the angle imposed by the beveled surface 62, the sheet material 30 will be severed precisely at the line of intersection 60 of the surfaces 56a, 56b.

As can be seen from the foregoing detailed description, the invention provides a unique cutting tool which is effective for performing a wide variety of precise cutting operations. In particular, the invention may be used to sever sheet material at a uniform predetermined distance from the line of intersection of two surfaces to which the sheet material is applied. As a result, the sheet material may be severed so as to provide a uniform predetermined overlap parallel to the line of intersection, or, if desired, the sheet material may be severed precisely at the line of intersection.

The invention may be advantageously used to precisely sever wallpaper applied to the surface of wall. In addition, the invention may be readily used to sever coating material or film applied to the balsa wood structure of a model. As should also be evident, the invention may be advantageously used in any similar applications where it is desired to perform similar cutting operations.

What is claimed is:

1. A tool capable of severing sheet material at a first uniform predetermined distance from a first line of intersection of a first surface and second surface forming an "inside" edge with an angle therebetween of less than 180°, and capable of severing sheet material at a second uniform predetermined distance from a second line of intersection of a third and fourth surface forming an "outside" edge with an angle therebetween of greater than 180°, said tool comprising:

a body with a front edge adapted to slidingly guide the tool along said first surface or said third surface and a substantially flat bottom surface adapted to slidingly guide the tool along said second surface, cutting means extending beyond said front edge of said body, which is maintained by said front edge and said flat surface of said body at said first predetermined distance from said first line of intersection, a removable spacer plate and means for engaging said removable spacer plate at a predetermined position with respect to said body, wherein said spacer plate includes a lip with a substantially flat surface adapted to slidingly guide said tool along said fourth surface, so that when said removable spacer plate is disengaged from said body, said tool may be guided along said first and second surfaces by said front edge and said bottom surface, respectively, such that said cutting means severs sheet material applied to said first surface at said first uniform predetermined distance from said first line of intersection, and when said removable spacer plate is engaged with said body, said tool may be guided along said third and fourth surfaces by said front edge of said body and said lip of said spacer plate, respectively, so that said cutting means severs sheet material applied to said third surface at said second uniform predetermined distance from said second intersection.

2. A tool for severing sheet material at a uniform predetermined distance from the line of intersection of a first surface and a second surface, said tool comprising:

a body with a front edge adapted to slidingly guide the tool along said first surface and a substantially flat bottom surface adapted to slidingly guide the tool along said second surface, and a substantially flat beveled surface extending between said bottom surface and said front edge adapted to slidingly guide the tool along said second surface at a predetermined angle with respect to said second surface, cutting means extending beyond said front edge of said body wherein when said tool is guided along said first and said second surfaces by said front edge and said bottom surface of said body, respectively, said cutting means severs sheet material applied to said first surface at said uniform predetermined distance from said line of intersection, and when said tool is guided along said first and said second surfaces by said said front edge and said beveled surface of said body, respectively, said cutting means severs sheet material applied across said line of intersection at said line of intersection.

3. The tool as set forth in claim 1 further comprising means for finely adjusting said cutting means to any point within the range defined by a fully retracted position wherein said cutting means does not extend beyond the front edge of said body and a fully extended position wherein said cutting means extends beyond said front edge of said body.

4. The tool as set forth in claim 1 further comprising abutment means for securely maintaining said cutting means at a predetermined relationship with respect to said body.

5. The tool as set forth in claim 1 wherein said tool is substantially symmetric about its transverse axis and said cutting means comprises a first cutting means on one side of said transverse axis and a second cutting means on the other side of said transverse axis.

6. The tool as set forth in claim 1 wherein said body includes a plurality of recesses to facilitate securely grasping the tool by hand.

7. A tool for severing sheet material at a uniform predetermined distance from the line of intersection of a first surface and a second surface, said tool comprising:

a body with a front edge adapted to slidingly guide the tool along said first surface, cutting means extending beyond said front edge of said body, and a spacer plate secured at a predetermined position with respect to said body, wherein said spacer plate includes a front lip extending beyond said front edge of said body, said spacer plate having a substantially flat surface which is spaced apart from said cutting means a distance that defines said uniform predetermined distance and which is adapted to slidingly guide said tool along said second surface, so that when said tool is guided along said first and said second surfaces by said front edge and said flat surface of said spacer plate, respectively, said cutting means severs sheet material applied to said first surface at said uniform predetermined distance from said line of intersection.

8. The tool as set forth in claim 7 further comprising means for securing said spacer plate to said body in a second predetermined position wherein the distance between said lip and said cutting means defines a second predetermined distance which differs from said predetermined distance.

9. The tool as set forth in claim 7 further comprising means for finely adjusting said cutting means to any point within the range defined by a fully retracted position wherein said cutting means does not extend beyond the front edge of said body and a fully extended position wherein said cutting means extends beyond said front edge of said body.

10. The tool as set forth in claim 7 further comprising abutment means for securely maintaining said cutting means at a predetermined relationship with respect to said body.

11. The tool as set forth in claim 7 wherein said tool is substantially symmetric about its transverse axis and wherein said cutting means comprises a first cutting means on one side of said transverse axis and a second cutting means on the other side of transverse axis.

12. The tool as set forth in claim 7 wherein said body includes a plurality of recesses to facilitate securely grasping the tool by hand.

13. A tool for severing sheet material at a uniform predetermined distance from the line of intersection of a first surface and a second surface, said tool comprising:

a body with a front edge adapted to slidingly guide the tool along said first surface, cutting means extending beyond said from edge of said body, and guidance means comprised of a front lip extending beyond said from edge of said body, said front lip having a substantially flat surface which is spaced apart from said cutting means a distance that defines said uniform predetermined distance and which is adapted to slidingly guide said tool along said second surface, so that when said tool is guided along said first and said second surfaces by said from edge and said flat surface of said from lip, respectively, said cutting means severs sheet material applied to said first surface at said uniform predetermined distance from said line of intersection.

* * * * *

UNITED STATES PATENT AND TRADEMARK OFFICE

CERTIFICATE OF CORRECTION

PATENT NO. : 5,410,813
DATED : May 2, 1995
INVENTOR(S) : Carlson

It is certified that error appears in the above-indentified patent and that said Letters Patent is hereby corrected as shown below:

Column 8, claim 11, line 58, insert --said-- after "of"--.
Column 8, claim 13, line 67, delete "from" and substitute --front--therefor.
Column 9, claim 13, line 2 , delete "from" and substitute --front--therefor.
Column 10, claim 13, line 2, delete both occurrences of "from" and substitute --front-- therfor in both instances.

Signed and Sealed this

Twenty-second Day of August, 1995

*Attest:*

Bruce Lehman

BRUCE LEHMAN

*Attesting Officer*

*Commissioner of Patents and Trademarks*